US006894210B1

(12) United States Patent
Lombardi

(10) Patent No.: US 6,894,210 B1
(45) Date of Patent: May 17, 2005

(54) ADJUSTABLE DRUM BEATING APPARATUS

(75) Inventor: Donald G. Lombardi, Thousand Oaks, CA (US)

(73) Assignee: Drum Workshop, Inc., Oxnard, CA (US)

( * ) Notice: Subject to any disclaimer, the term of this patent is extended or adjusted under 35 U.S.C. 154(b) by 104 days.

(21) Appl. No.: 10/283,898

(22) Filed: Oct. 31, 2002

(51) Int. Cl.[7] ..... G10D 13/02
(52) U.S. Cl. ..... 84/422.1; 84/422.2; 84/422.3
(58) Field of Search ..... 84/422.1, 422.2, 84/422.3

(56) References Cited

U.S. PATENT DOCUMENTS

| | | | | |
|---|---|---|---|---|
| 2,027,869 A | | 1/1936 | La Londe | |
| 2,845,830 A | | 8/1958 | Haviland | |
| 3,742,806 A | | 7/1973 | Zalmer | |
| 3,747,464 A | | 7/1973 | Russell | |
| 3,797,356 A | * | 3/1974 | Duffy et al. | 84/422.1 |
| 4,346,638 A | * | 8/1982 | Hoshino | 84/422.1 |
| 4,691,613 A | | 9/1987 | Jacobson | |
| 4,782,733 A | | 11/1988 | Herring | |
| 5,540,131 A | * | 7/1996 | Shigenaga | 84/422.1 |
| 5,627,332 A | | 5/1997 | Lombardi | |
| 5,990,401 A | | 11/1999 | Braun et al. | |
| 6,137,040 A | | 10/2000 | Hoshino | |

* cited by examiner

*Primary Examiner*—Shih-Yung Hsieh
(74) *Attorney, Agent, or Firm*—William W. Haefliger

(57) ABSTRACT

An adjustable drum beating device, comprising at least one rotor operable to rotate a drum beater, a foot pedal driven flexible driver having a path of engagement with the rotor and operable to rotate the rotor, the driver having adjustable connection to the rotor to effectively adjust the position of the foot pedal relative to the rotor, and there being adjustably relatively movable parts associated with at least one rotor to adjust the configuration of the path of engagement of the flexible driver with the rotor.

13 Claims, 8 Drawing Sheets

24

20
30a
90a
18
87a
22
30
58
31
30b

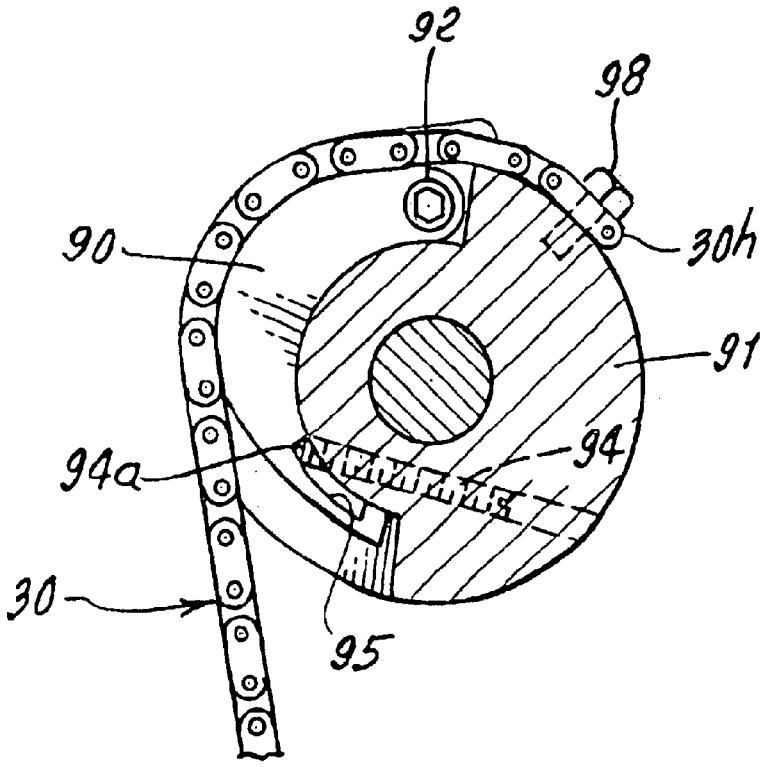
FIG. 12.
FIG. 13.
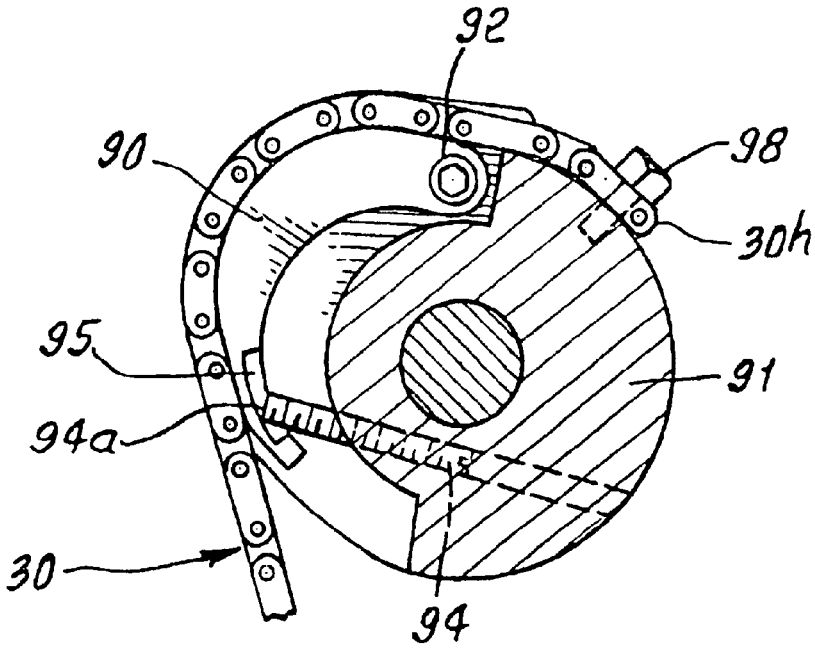

ADJUSTABLE DRUM BEATING APPARATUS

BACKGROUND OF THE INVENTION

This invention relates generally to improvements in bass drum beating equipment; more particularly it concerns enhanced drum beating capability and adjustable beater movement toward the drum, adjustable beater movement relative to a foot pedal, and enhanced stability, support and integration of such apparatus to improve its operability, use, and lengthen the life of such equipment.

Prior drum beating mechanisms as disclosed for example in U.S. Pat. Nos. 4,756,224; 4,188,853; 3,797,356; 3,750,517; 3,742,806; 3,543,632; 3,195,391; and 2,845,830 have lacked the unusual advantages and combinations of advantages, structurally and functionally, of the present invention. For example, prior drum beaters were collapsible, which weakened them structurally, in use, and they tended to move about during foot pedaling. Also, beater movement in response to pedal movement was too slow for many drummers. The present invention represents a substantial and unusual advance over the prior art, and fills a need for the above advantages as well as additional advantages as will appear.

SUMMARY OF THE INVENTION

Basically, the invention is embodied in a foot-operated, bass drum pedal assembly and includes in combination:

a) at least one rotor operable to rotate a drum beater, b) a foot pedal driven flexible driver having a path of engagement with the rotor and operable to rotate the rotor, the driver having adjustable connection to the rotor to effectively adjust the position of the foot pedal relative to the rotor, c) there being adjustably relatively movable parts associated with said at least one rotor to adjust the configuration of the path of engagement of the flexible driver with the rotor.

As will appear, the speed of reaction and/or rotation of the beater in response to pedal movement is thereby enhanced, for more accurately timed drum beating; and pedal return to-up-position is adjustable to achieve desired acceleration, to more quickly position the pedal to selected position for a subsequent down push, for the next drum beat.

Additional objects include the provision of a control to hold the movable parts in adjusted position corresponding to a selected configuration of said path; the provision of a clamp to clamp together said parts after adjusted relative movement of the parts; the provision of interengagable teeth or serrations on the clamp and on the rotor to enable selective positioning of the parts; and the provision of such parts having slide or pivotal interconnection.

A further object includes provision of a tension spring biasing the rotor toward a rest position, the spring having an end portion remote from the rotor, and a swivel connection between said spring end portion and a support.

Yet another object includes provision of a base plate, at least one pedestal on the base plate, an axle carried by the pedestal, and defining an axis, the rotor carried by the axis to rotate about said axis, the foot pedal carried to pivot relative to the base plate.

These and other objects and advantages of the invention, as well as the details of an illustrative embodiment, will be more fully understood from the following specification and drawings, in which:

DRAWING DESCRIPTION

FIG. 12 is a side elevation of a hub, showing modified adjustable parts; and FIG. 13 is a view like FIG. 12, showing the adjustable parts in extended position.

DETAILED DESCRIPTION

Figure 1:
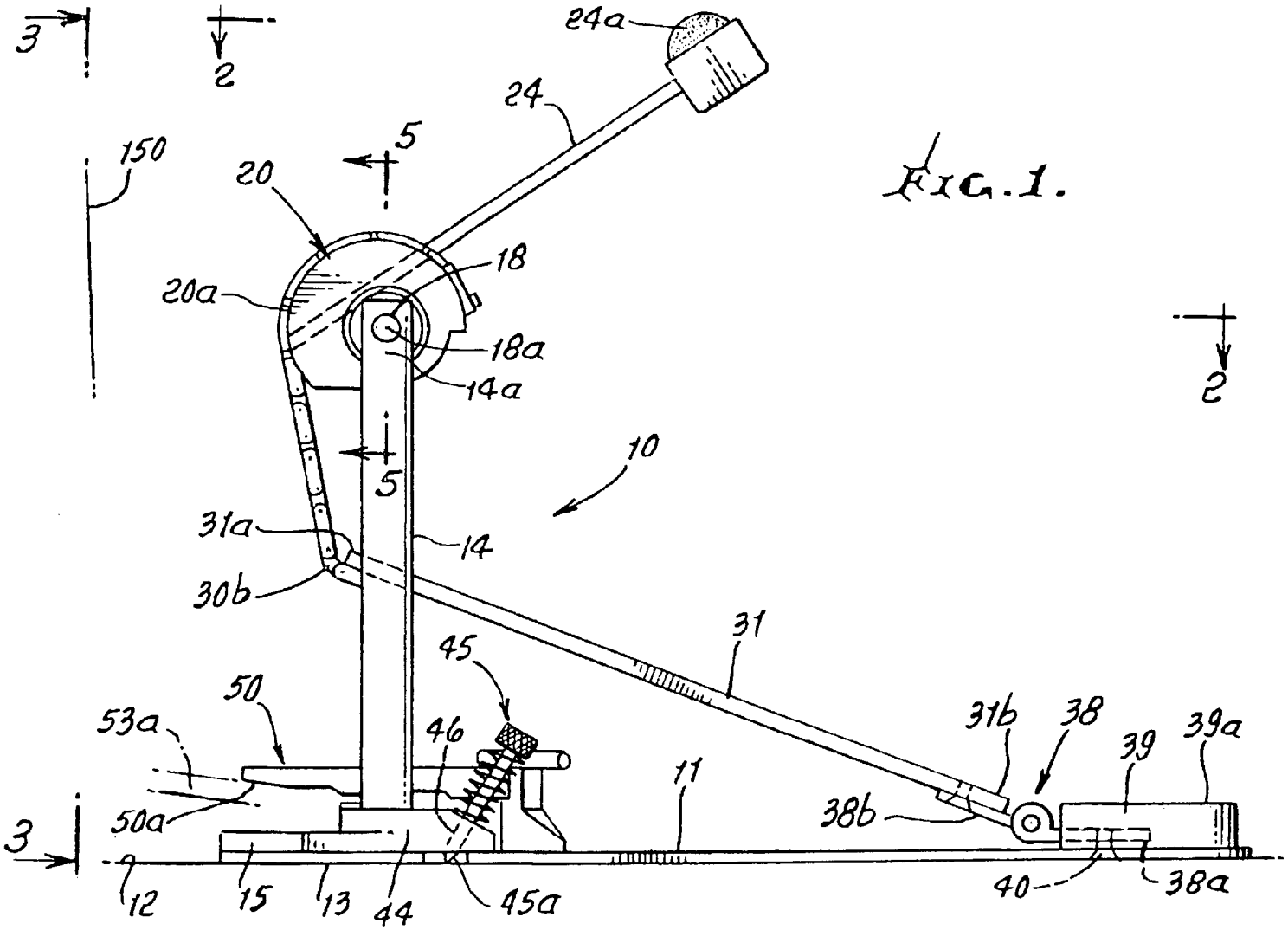
FIG. 1 is a side elevation showing preferred apparatus incorporating the invention.
Figure 2:
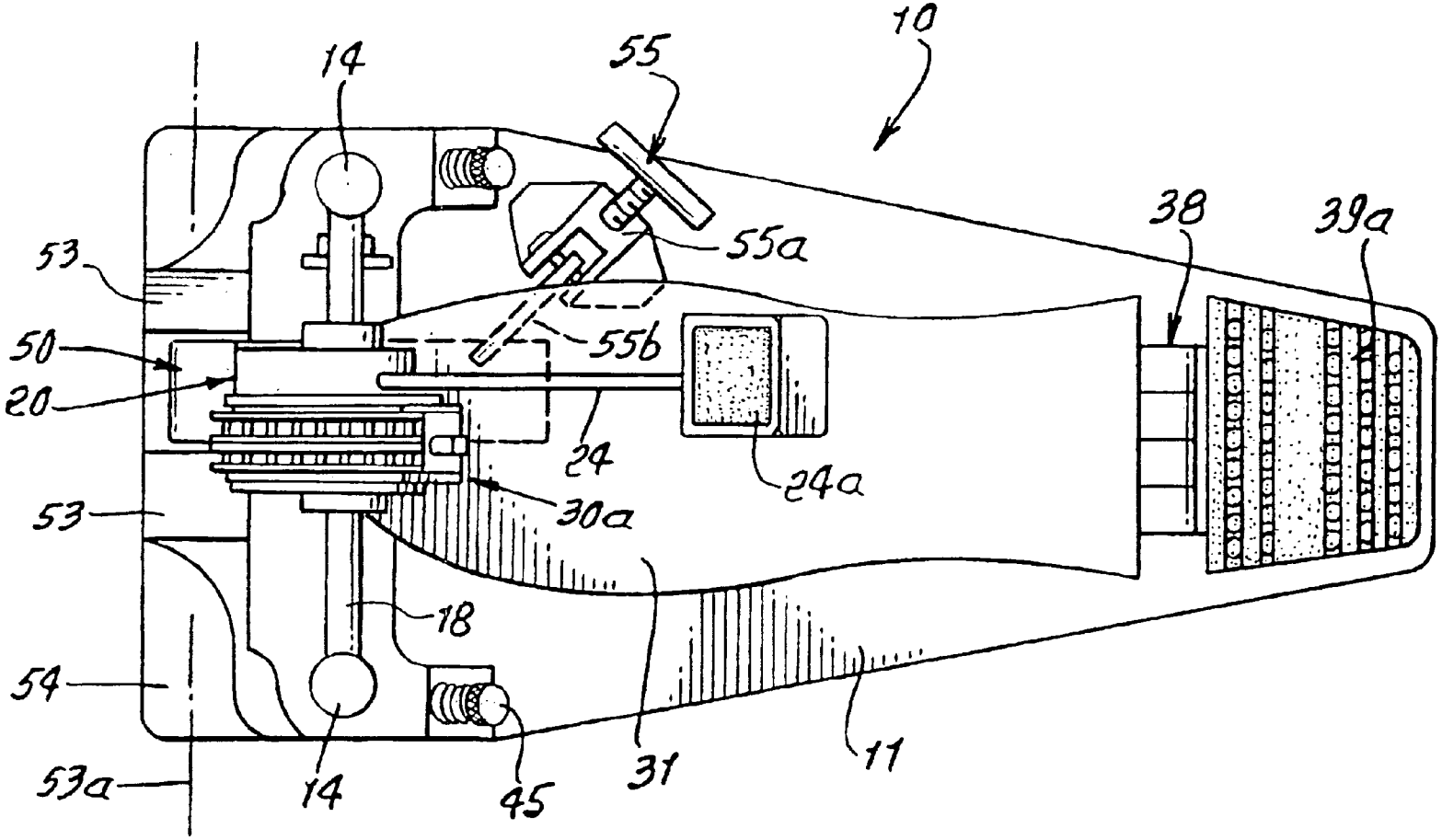
FIG. 2 is a top plan view taken on lines 2—2 of FIG. 1.

The foot-operated bass drum pedal assembly 10 illustrated includes forwardly longitudinally elongated, horizontal base plate 11 which is relatively heavy and metallic to anchor the device on a floor surface 12. In this regard, the plate may consist of steel, and typically carries an elastomer layer 13 such as rubber on its underside to grip the floor. The underside of layer 13 may be serrated to enhance the grip.

Mounted to the upper side of the plate is a sub-assembly that includes two upright laterally spaced pedestals 14 interconnected by a bottom yoke plate 15. These elements are also metallic, and may consist of steel. The yoke plate is attached to plate 11 by suitable threaded fasteners.

A horizontal shaft 18 extends laterally between, and is rotatably supported by the two pedestals, near their uppermost extents; to this end, suitable shaft bearings 16 may be located in the pedestal upper end portions 14*a*.

Figure 5:
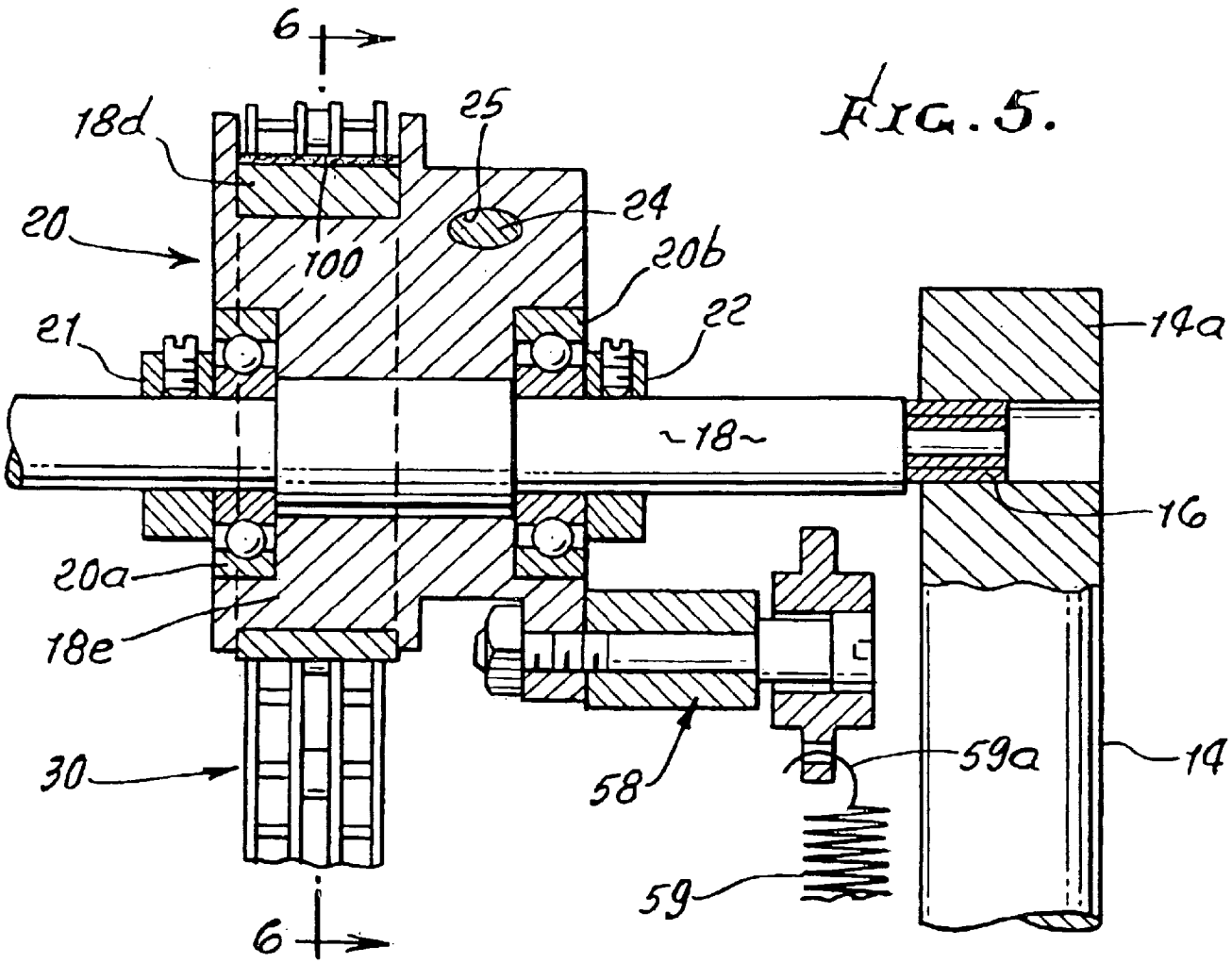
FIG. 5 is a vertical section taken on lines 5—5 of FIG. 1.

A hub or rotor 20 is carried by the shaft 18, and may rotate on the shaft, as enabled by bearings as seen at 20*a* and 20*b* in FIG. 5. Positioners 21 and 22 engage the bearing inner races to locate the hub or rotor on the shaft. The rotor 20 carries a stick or beater rod 24, via a bore 25 in the rotor. A beater head 24*a* is attached to the opposite and remote end of the rod or shaft 24.

Figure 6:
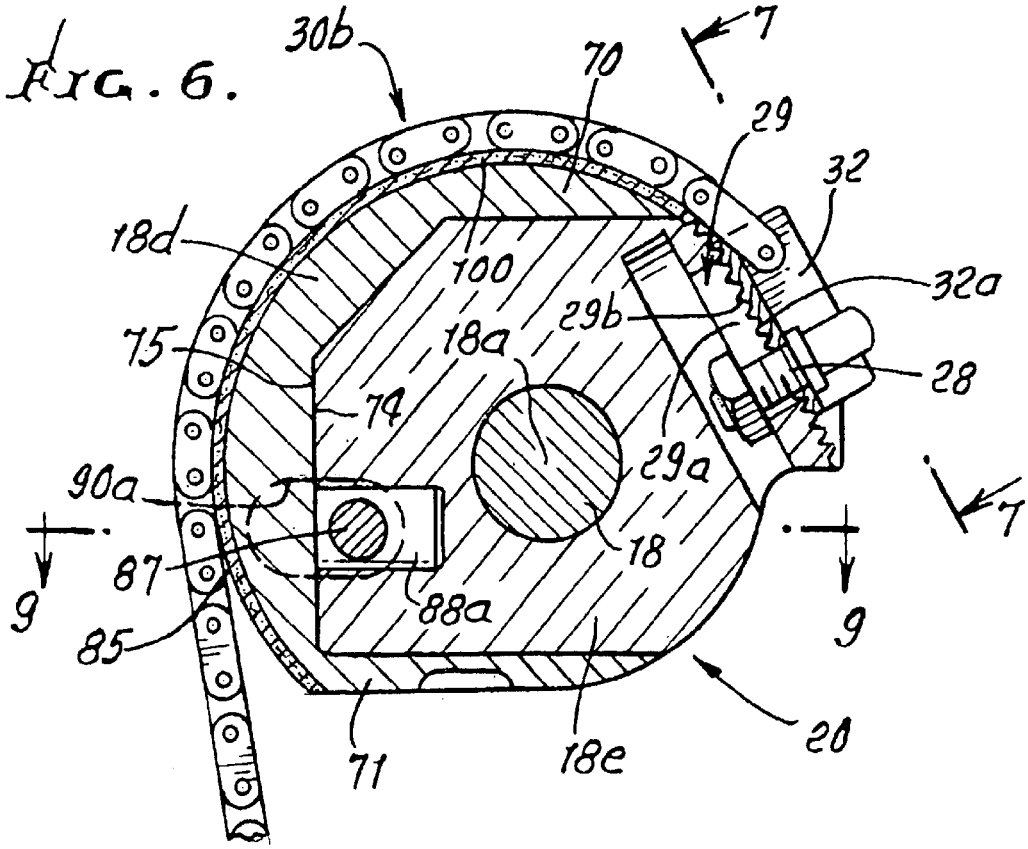
FIG. 6 is a section taken on lines 6—6 of FIG. 5.
Figure 7:
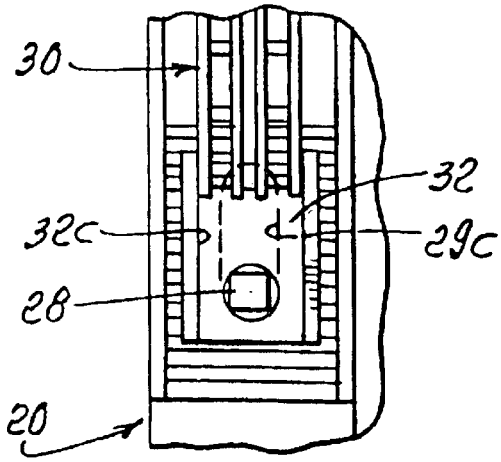
FIG. 7 is a fragmentary view taken on lines 7—7 of FIG. 6 to show drive chain end retention.
Figure 8:
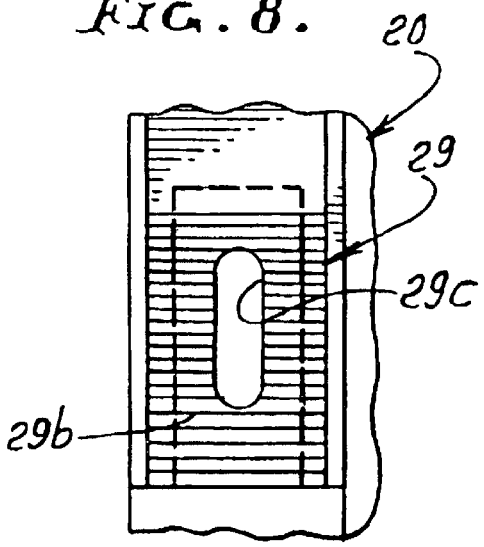
FIG. 8 is a view like FIG. 7, but with the chain removed from the rotor (or hub)

Flexible driver chain 30 is entrained on the rotor or hub 20 and has opposite end portions, one of which is anchored to the rotor at 30*a*, spaced above the base plate and above a pedal 31. A non-metallic liner 100 on the rotor is engaged by the chain. FIG. 6 shows a chain anchor link 32 attached as by a fastener 28 to the rotor. An adjustable connection at 29 enables endwise adjustment of link 32 relative to a retainer 29*a* on the rotor. Fastener 28 extends through slots 29*c* and 32*c* in 29 and 32. When fastener 28 is loosened, serrations or teeth 32*a* on link 32 may be adjustably slipped over teeth 29*b* on retainer 29*a* to enable endwise or path-wise adjustment of the chain along the rotor periphery. Fastener parts 28*a* and 28*b* grip 29 and 32 to hold the teeth in engagement. This adjustability of parts enables adjustment of pedal angle of inclination relative to the base plate, as will appear.

The forwardly elongated pedal extends in inclined relation above the base plate, and has a forward portion 31*a* of the pedal attached to the lower end 30*b* of the chain dependent below the forwardmost extent to the hub, to be displaced downwardly as the pedal is pressed downwardly, thereby rotating the rotor and beater, to beat the bass drum 150.

Figure 4:
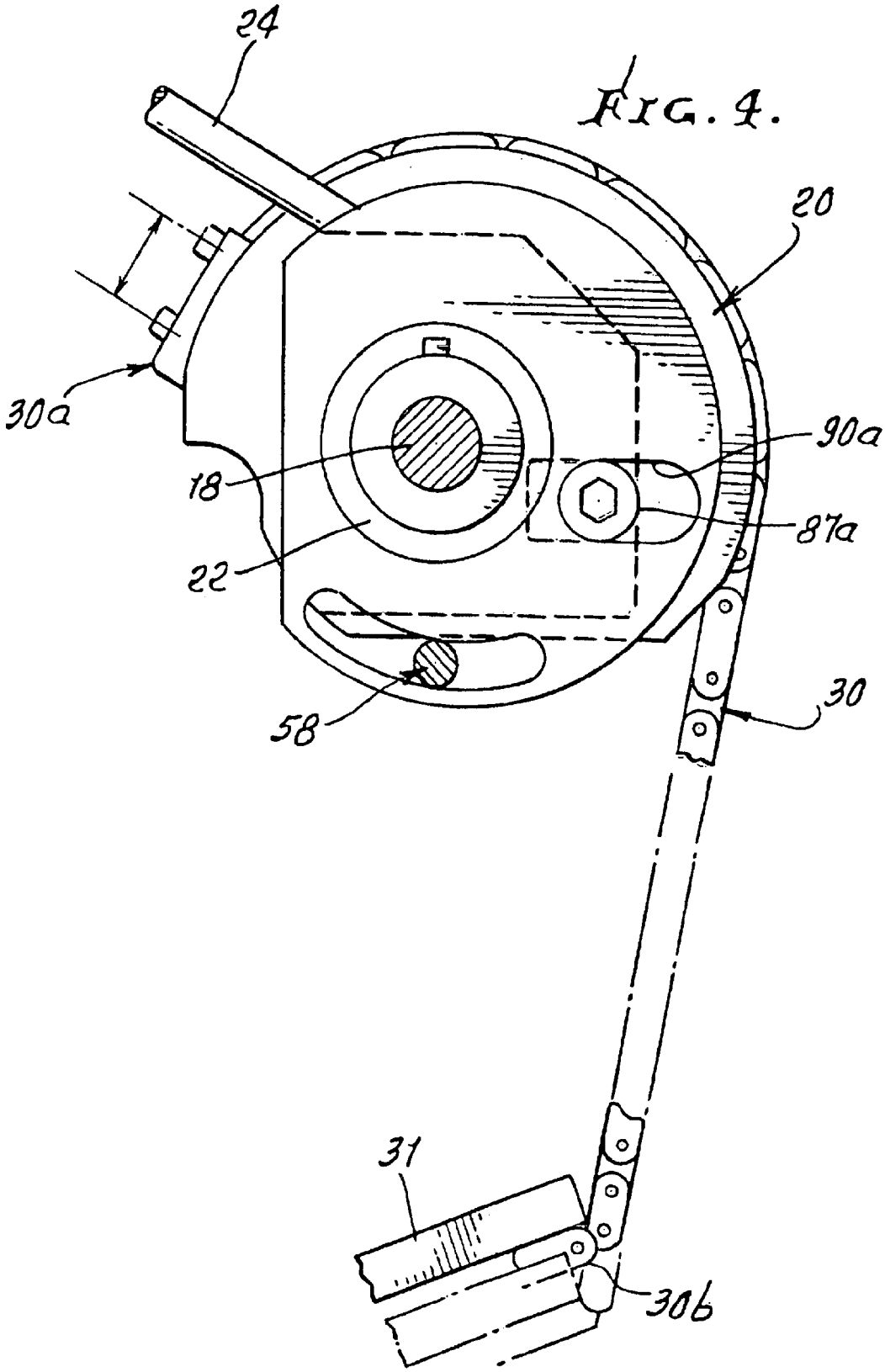
FIG. 4 is an enlarged elevation taken on lines 4—4 of FIG. 3.

It will be noted that the rotor periphery 20*a*engaged by the chain is adjustably eccentric to the axis 18*a* of rotation of the rotor and axle shaft 18. In particular, the chain has a mid-portion 30*b* being at progressively increasing distance (compare large distance $d_1$, with lesser distance $d_2$, for example, in FIG. 4) from the axis 18*a*, along the chain length or path in a direction toward the dangling chain portion 30*a* below the hub. As a result, the pedal accelerates, faster, the travel of the beater toward the drum, as during initial rotation of the hub by the chain, due to the longer torque arm, of which $d_1$, is representative, relative to the shorter torque arm as at $d_2$ which are in effect as the hub completes it rotation and as the beater closely approaches the drum. This also enables more accurate timing of drum beating. Also, the cam effect serves to move more rapidly the chain extent hanging below the hub, as the chain returns to the hub, thereby bringing the pedal up faster than if the hub rotated about its true center.

Figure 10:
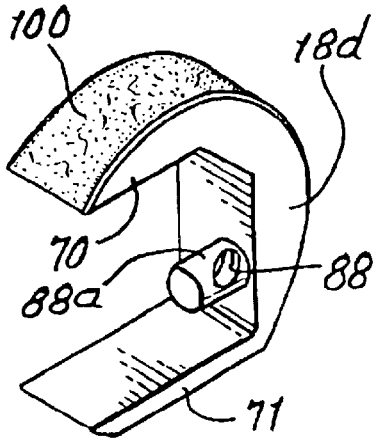
FIG. 10 is a perspective view of one adjustable part of the rotor or hub.
Figure 11:
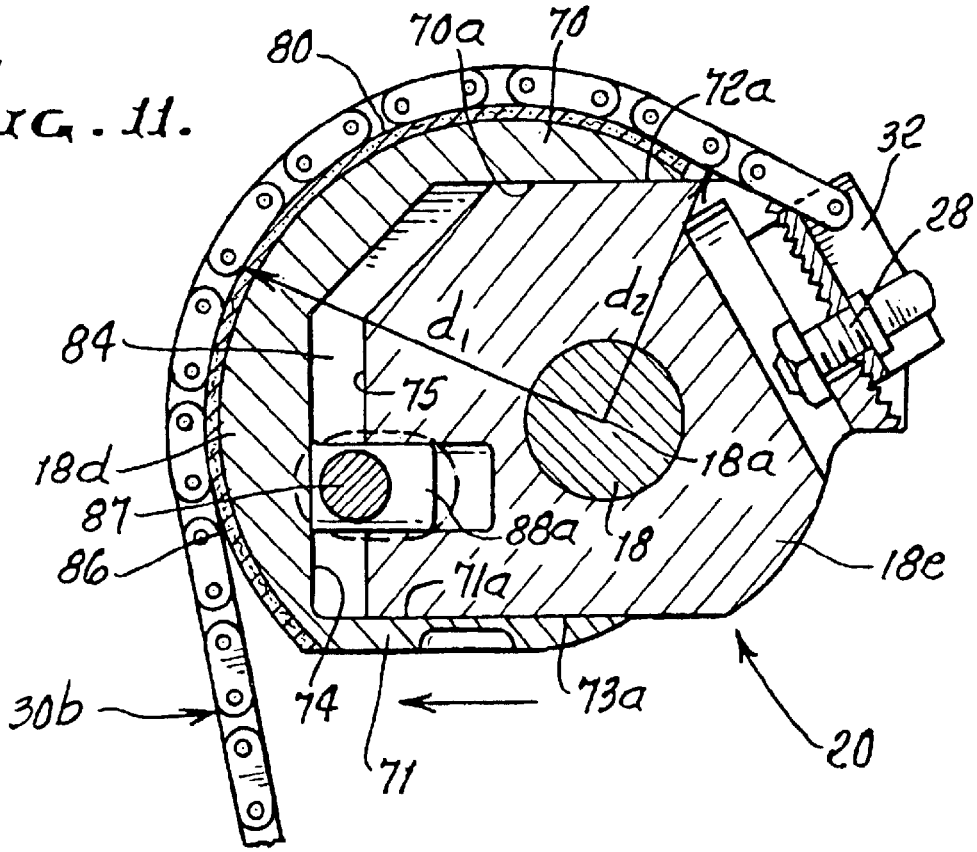
FIG. 11 is a view like FIG. 6, but showing two hub or rotor parts in an adjusted (extended) position.

FIGS. 6, 10 and 11 show provision of one form of adjustably relatively movable parts associated with rotor or hub 18, for adjusting the configuration of the eccentric path 80 of engagement of the flexible driver, such as chain 30, with the rotor, i.e. to increase or decrease the eccentricity to best adapt to drum beating. As shown, the parts may take the form of adjuster hub part 18*d* slidably movable on and relative to hub part 18*e* to adjust the eccentricity of the chain pathway 80 on the hub. See parallel slide and guide surfaces 70*a* and 71*a* on arms 70 and 71 of part 18*d*, and which are respectively slidably engageable with slide surfaces 72*a* and 73*a* or part 18*e*.

Accordingly, slide surfaces 72*a* and 73*a* serve as a form of guide means to enable guided bodily displacement of one part or section 18*d* outwardly relative to the other part of section 18*e*.

In FIG. 11, part 18*d* has been displaced leftwardly relative to part 18*e*, creating a gap 84 between stop surface 74 on part 18*d* and stop surface 75 on part 18*e*. In FIG. 6, surfaces 74 and 75 are engaged. Also, in FIG. 6, the eccentricity $e_1$ of the path of chain travel on the hub is determined by radius $r_2$ relative to radius $r_1$, where $r_1$, is the radius from axis 18*a* to serrations 32*a* on link 32, and $r_2$ is the radius from axis 18*a* to the rotor chain path point 85 where the chain leaves the hub; and in FIG. 11 the eccentricity $e_2$ of the path of chain travel on the hub is determined by radius $r_3$ relative to radius $r_1$, where $r_3$ is the radius from axis 18*a* to the displaced or adjusted rotor chain path point 86 where the chain leaves the hub. Note that $r_3 > r_2$, and $e_2 > e_1$.

Figure 9:
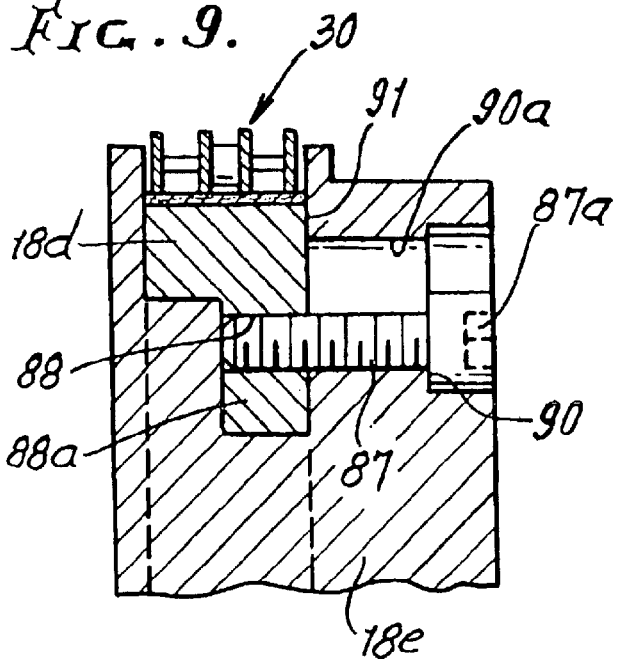
FIG. 9 is a horizontal section taken on lines 9—9 of FIG. 6.

A fastener 87 is tightenable to secure part 18*d* to part 18*e* at adjusted positions of desired eccentricity, between $e_1$ and $e_2$. The fastener extends in a direction parallel to axis 18*a*, and into a threaded bore 88 on a lug 88*a* integral with part 18*d*. See FIG. 9. When tightened, fastener head 87*a* clamps against shoulder 90 on part 18*e*, which in turn effects frictional clamping of part 18*d* against part 18*e*, at interface 91. See FIG. 9. Release of the fastener, enables relative shifting of parts 18*d* and 18*e*. See also guide slot 90*a* in 18*e* to accommodate relative shifting of 18*d* and 18*e* with fastener 87 extending in that slot.

Accordingly, threaded fastener 87 serves as a form of retention means to retain part or section 18*d*in a selected outwardly displaced position relative to the other part or section 18*e*. See FIGS. 9 and 11.

The pedal has a rear end portion 31*b* pivotally connected to the base plate near the rearward end thereof. Of unusual advantage for this purpose is a piano hinge 38 which extends transversely between the pedal rearwardmost portion and a heel pad 39. See FIG. 1. The hinge has two leaves, 38*a* and 38*b*. Leaf 38*a* projects rearwardly into the hard rubber heel pad to be anchored thereby, and the other leaf 38*b* is attached to the pedal rearwardmost extent, at the underside thereof. The heel pad is attached to the base plate, as by fasteners 40, and the treaded upper surface 39*a* of that pad is slightly higher in elevation than the top of the hinge 38, or at the same level as that top.

Bolts 45 are threadably attached at 46 to a cross-piece 44 and have tapered lower ends 45*a* that extend downwardly and forwardly at opposite lateral sides of the base plate, to adjustably penetrate or grip a floor surface for blocking forward bodily displacement of the base plate, in use.

A clamp finger 50 is rotatably carried by the yoke, as at lateral pivot locations 51, to pivot axis 52. The yoke also has two tongues 53 that extend forwardly beneath the level of the clamp finger, and at laterally opposite sides thereof, the tongues supported by the base plate. In use, the tongues support the downwardly convex lower side of the bass drum rim 53*a*as at locations 54. The upper side of the rim is downwardly clamped by the forward portion 50*a* of the finger 50. Downward pivoting of the finger forward portion is adjustably effected by a set screw 55 threaded through a part 55*a*, and bearing on a finger 55*b* that in turn bears on clamp finger 50.

Figure 3:
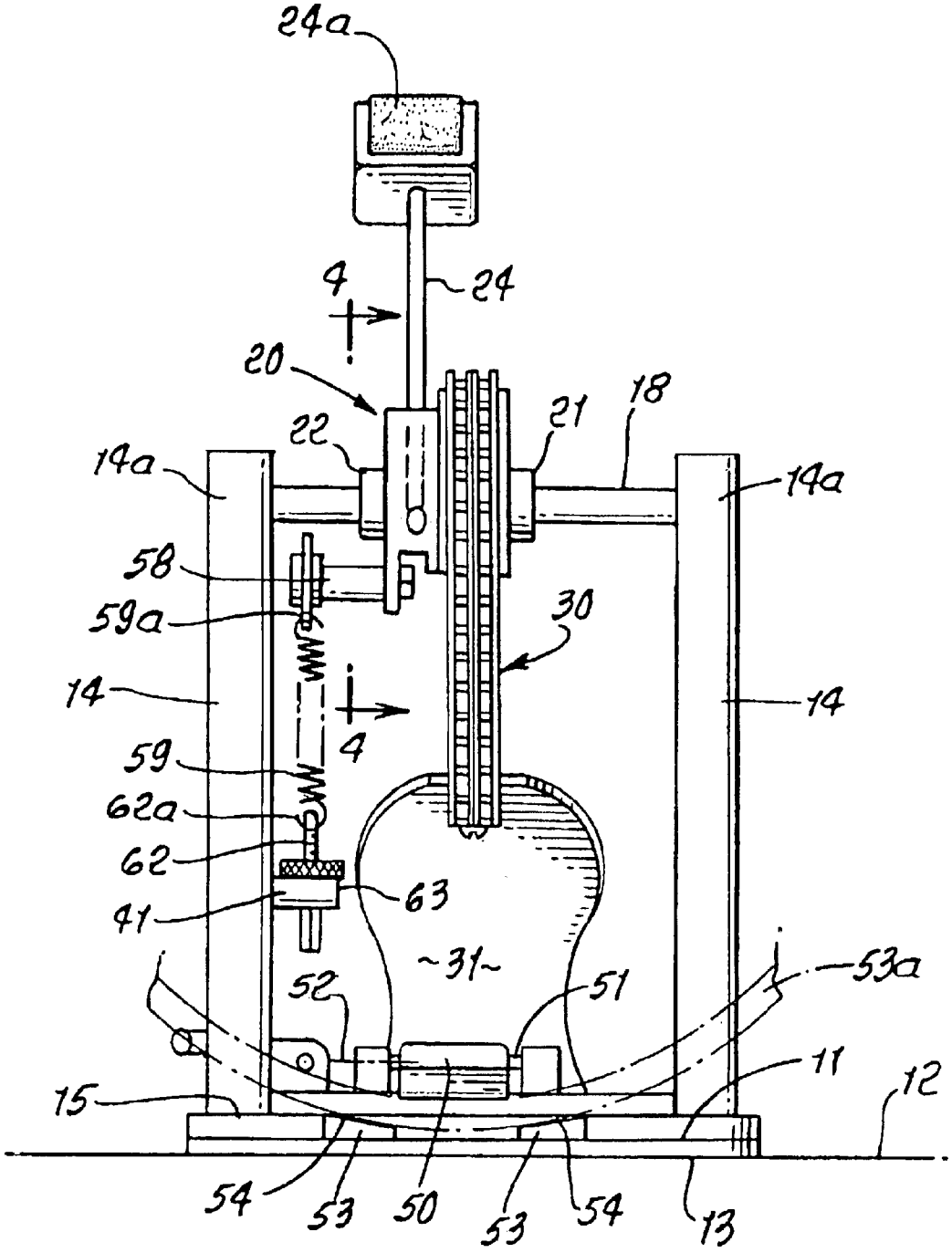
FIG. 3 is a front elevation taken on lines 3—3 of FIG. 1.

As seen in FIG. 3, upright return spring 59 has its upper end attached to a connector 58 at 59*a*, and its lower end adjustably attached to a swivel 41, which is carried by a pedestal 14, that minimizes friction as the hub rotates, due to pendulum pivoting of the swivel.

A threaded connector 62 attached to the lower end of the spring at 62*a* is rotatable in a threaded opening in swivel pin 63 rotatably carried by the pedestal, to adjust the spring tension. Connector 58 is eccentrically carried by an offset 42 on the hub.

Accordingly, a sturdy, compact, reliable and more accurate pedal unit is provided.

FIGS. 12 and 13 show hub parts 90 and 91, pivotably interconnected at 92, and relatively adjustable as between positions seen in FIGS. 12 and 13 to vary the configuration of the chain driver path (increased or decreased eccentricity). The pivoted and secured position of part 90 determines chain path eccentricity. An adjuster 94 may extend between 90 and 91 to adjust their relative positions. Tip 94*a* of the adjuster may slide in a slot 95 in 90. Chain end 30*h* is shiftable when retainer 98 is loosened.

I claim:

1. An adjustable drum beating device, comprising, in combination, a) at least one rotor operable to rotate a drum beater, b) a foot pedal driven flexible driver having a path of engagement with the rotor and operable to rotate the rotor, the driver having adjustable connection to the rotor to effectively adjust the position of the foot pedal relative to the rotor, c) there being adjustably relatively movable parts assembled as parts of the rotor to adjust the configuration of said path of engagement of the flexible driver with the rotor, the driver engaging both of said parts, one of said parts being a pusher locally peripherally bounded by the driver so as to push the driver outwardly as said one part is moved relative to another said part, there being guide means to enable guided bodily displacement of said one part outwardly relative to said other part and retention means to then retain said one part in a selected outwardly displaced position, relative to said other part.

2. The combination of claim 1 wherein said retention means comprises a threaded fastener retained by at least one of said parts.

3. The combination of claim 1 wherein said retention means includes a clamp to clamp together said parts after adjusted relative movement of the parts.

4. The combination of claim 3 wherein said clamp projects in a direction generally parallel to an axis defined by said at least one rotor.

5. The combination of claim 1 wherein said adjustable connection of the driver to the rotor includes a releasable clamp retaining an end portion of the flexible driver to said rotor, and spaced from said retention means.

6. The combination of claim 1 wherein said adjustable movable parts have adjustable slide interconnection.

7. The combination of claim 1 wherein said adjustably movable parts have adjustable pivotal interconnection.

8. The combination of claim 1 including a tension spring urging the rotor toward a rest position, the spring having an end portion remote from the rotor, and a swivel connection between said spring end portion and a support.

9. The combination of claim 1 including a base plate, at least one pedestal on a base plate, an axle carried by the pedestal, and defining an axis, the rotor carried by the axle to rotate about said axis, the foot pedal carried to pivot relative to the base plate.

10. An adjustable drum beating device, comprising a) at least one rotor operable to rotate a drum beater, b) a foot pedal driven flexible driver having a path of engagement with the rotor and operable to rotate the rotor, the driver having adjustable connection to the rotor to effectively adjust the position of the foot pedal relative to the rotor, c) there being adjustably relatively movable parts associated with said at least one rotor to adjust the configuration of said path of engagement of the flexible driver with the rotor, the driver engaging both of said parts, d) said adjustable connection of the driver to the rotor including a releasable clamp retaining an end portion of the flexible driver to said rotor, e) said releasable clamp includes adjustably interengagable teeth carried by said rotor and by said flexible driver.

11. The combination of claim 10 wherein the releasable clamp also includes a fastener operable to hold said teeth in interengagement.

12. An adjustable drum beating device, comprising a) at least one rotor operable to rotate a drum beater, b) a foot pedal driven flexible driver having a path of engagement with the rotor and operable to rotate the rotor, the driver having adjustable connection to the rotor to effectively adjust the position of the foot pedal relative to the rotor, c) the rotor having relatively adjustable movable sections which are interconnected in selected relative positions in which the driver is held Pushed relatively away from the rotor, and one section is pushed outwardly relative to the other section, to shorten the effective length of the driver, d) and retention means for retaining said sections in said selected relative positions.

13. adjustable drum beating device, comprising a) at least one rotor operable to rotate a drum beater, b) a foot pedal driven flexible driver having a path of engagement with the rotor and operable to rotate the rotor, c) there being adjustably relatively movable parts assembled and connected as parts of the rotor to adjust the configuration of said path of engagement of the flexible driver with the rotor, d) one of said Parts peripherally bounded by the driver so as to push the driver outwardly, e) and retention means for returning said parts in selected relative positions, in which one part is replaced displaced outwardly away from an axis defined by the rotor.

* * * * *